US006585319B2

(12) United States Patent
Tseng

(10) Patent No.: US 6,585,319 B2
(45) Date of Patent: Jul. 1, 2003

(54) SWING CHAIR ASSEMBLY WITH A TABLE UNIT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 57 days.

(21) Appl. No.: 09/948,152

(22) Filed: Sep. 6, 2001

(65) Prior Publication Data

US 2003/0042776 A1 Mar. 6, 2003

(51) Int. Cl.[7] ..... A63G 9/00

(52) U.S. Cl. ..... 297/281; 297/735; 297/232; 297/277; 472/125

(58) Field of Search ..... 297/135, 170, 297/232, 273, 277, 281; 472/118, 125

(56) References Cited

U.S. PATENT DOCUMENTS 2,547,891 A * 4/1951 Smith ..... 297/281
3,408,032 A * 10/1968 Francis ..... 297/188.18
3,825,299 A * 7/1974 Gaucher ..... 297/157.1
3,893,729 A * 7/1975 Sherman et al. ..... 297/118
4,620,702 A * 11/1986 Hemmeter ..... 297/245
5,649,737 A * 7/1997 Behnke ..... 297/170
5,803,818 A * 9/1998 Tseng ..... 472/118

FOREIGN PATENT DOCUMENTS

FR 320004 * 11/1902 ..... 297/273

* cited by examiner

*Primary Examiner*—Peter R Brown
(74) *Attorney, Agent, or Firm*—Ladas & Parry

(57) ABSTRACT

A swing chair assembly includes a support unit, a seat unit disposed among a pair of upright side frames and a horizontal bar of the support unit, and linking units for connecting the seat unit pivotally and swingably to the horizontal bar. The seat unit includes a chair member with a horizontal seat portion and an upright backrest portion, and a table unit disposed adjacent to the seat portion of the chair member. The table unit has a horizontal table top disposed in a raised position with respect to the seat portion of the chair member.

11 Claims, 4 Drawing Sheets

SWING CHAIR ASSEMBLY WITH A TABLE UNIT

BACKGROUND OF THE INVENTION

1. Field of the Invention

The present invention relates to a swing chair assembly, more particularly to a swing chair assembly having a swingable seat unit that is provided with a table unit to permit placing of food, drinks, and other objects on the table unit.

2. Description of the Related Art

A conventional swing assembly includes a pair of spaced-apart upright side frames, a horizontal bar extending between upper ends of the side frames, and a seat unit disposed among the side frames and the horizontal bar and suspended on the horizontal bar. The seat unit is provided with a chair member with a horizontal seat portion and an upright backrest portion. The seat unit of the conventional swing assembly is not provided with a table for placing of food, drinks and other objects thereon. Since the swing chair assembly is usually installed outdoors, and since many outdoor activities require the serving of food and refreshments, it is thus desirable to provide a table on the swing chair assembly to permit the placing of food, drinks, and other objects thereon.

SUMMARY OF THE INVENTION

Therefore, the main object of the present invention is to provide a swing chair assembly having a seat unit with a table unit adjacent to a chair member.

Accordingly, the swing chair assembly of the present invention includes a support unit, a seat unit, and a pair of linking units. The support unit includes a pair of spaced-apart upright side frames with lower end portions adapted to be supported on a ground surface, and upper end portions, and a horizontal bar extending between and interconnecting the upper end portions of the side frames. The seat unit is disposed among the side frames and the horizontal bar. The linking units are spaced-apart along a longitudinal direction of the horizontal bar. Each of the linking units has an upper end connected pivotally to the horizontal bar, and a lower end connected pivotally to the seat unit, thereby suspending the seat unit swingably above the ground surface. The seat unit includes a seat frame pivoted to the lower end of the linking units, at least one chair member, and a table unit mounted on the seat frame. The chair member includes a horizontal seat portion with a rear end, and an upright backrest portion extending upwardly from the rear end of the seat portion. The table unit is disposed adjacent to the seat portion of the chair member, and has a horizontal table top which is disposed in a raised position with respect to the seat portion of the chair member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
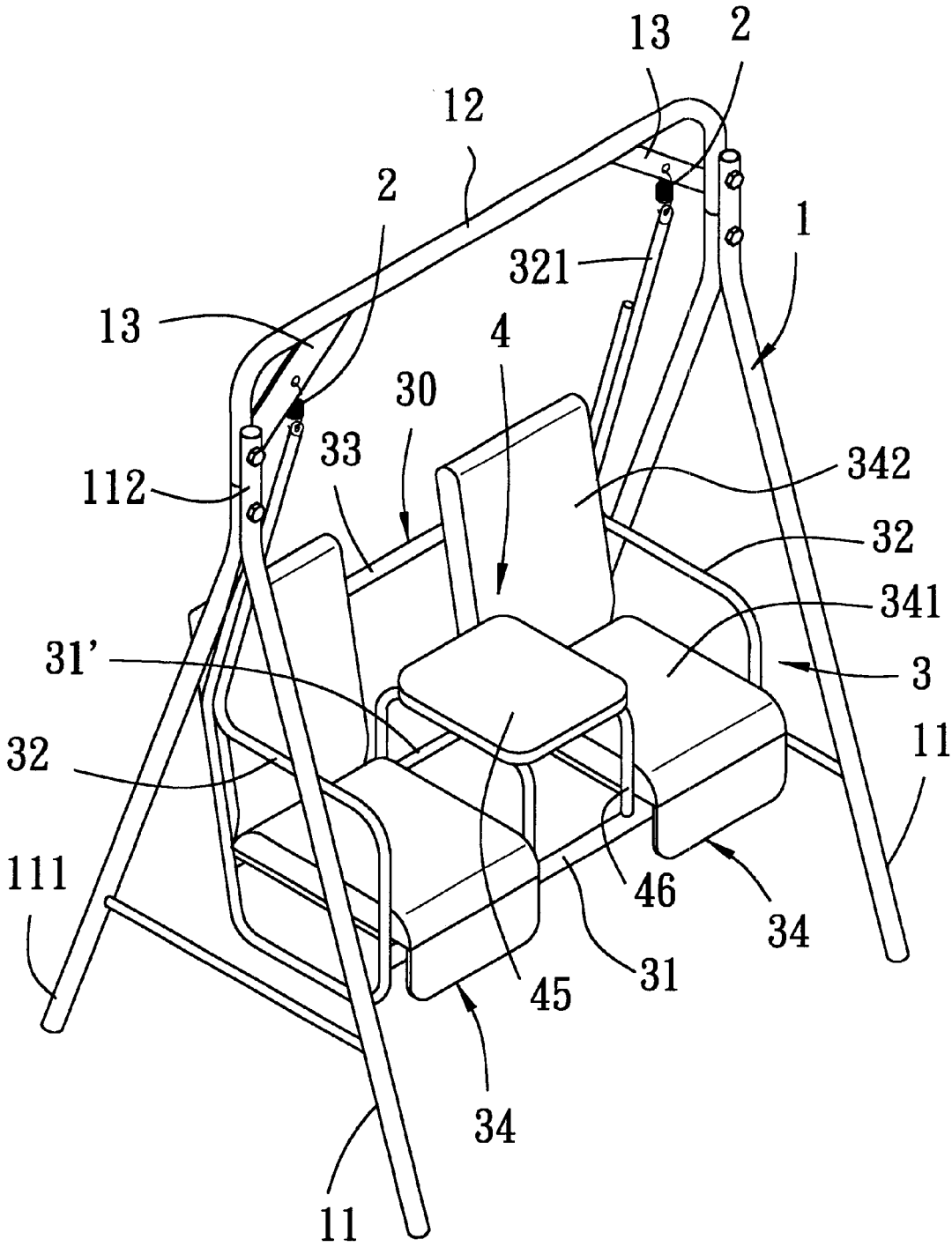
FIG. 1 is a perspective view of a first preferred embodiment of the swing chair assembly of the present invention.

Before the present invention is described in greater detail, it should be noted that like elements are denoted by the same reference numerals throughout the disclosure.

Referring to FIG. 1, the first preferred embodiment of the swing chair assembly of the present invention is shown to include a support unit 1, a seat unit 3, and a pair of linking units 2. The support unit 1 includes a pair of spaced-apart upright side frames 11 with lower end portions 111 adapted to be supported on a ground surface, and upper end portions 112. A horizontal bar 12 extends between and interconnects the upper end portions 112 of the side frames 11. The seat unit 3 is disposed among the side frames 11 and the horizontal bar 12. Each of a pair of elongated hanger plates 13 extends between the horizontal bar 12 and the upper end portion 112 of an adjacent side frame 11. The linking units 2 are spaced-apart along a longitudinal direction of the horizontal bar 12. Each of the linking units 2 is in the form of a spring in the present embodiment, and has an upper end connected pivotally to one of the hanger plates 13, and a lower end connected pivotally to the seat unit 3 for suspending the seat unit 3 swingably above the ground surface.

The seat unit 3 includes a seat frame 30 which has two spaced-apart armrest frame portions 32, each having an upwardly extending section 321 with an upper end connected to the lower end of a respective one of the linking units 2. The seat frame 30 further has front and rear bottom rails 31, 31' parallel to the horizontal bar 12 and extending between the armrest frame portions 32, and a horizontal backrest support rod 33 disposed above the rear bottom rail 31' and extending between the upwardly extending sections 321 of the armrest frame portions 32. The seat unit 3 further includes a pair of chair members 34 disposed adjacent to the armrest frame portions 32, respectively, and a table unit 4 disposed between the chair members 34. Each of the chair members 34 includes a horizontal seat portion 341 and an upright backrest portion 342 extending upwardly from a rear end of the seat portion 341. The seat portion 341 is disposed to rest on the front and rear bottom rails 31, 31', and the backrest portion 342 lies against the backrest support rod 33. The table unit 4 is disposed between the seat portions 341 of the chair members 34, and includes a leg unit with four upright legs 46. Lower ends of an anterior pair of the legs 46 are connected, such as by welding, to the front bottom rail 31. Lower ends of a posterior pair of the legs 46 are connected to the rear bottom rail 31', such as by welding. The table unit 4 further includes a horizontal table top 45 which is in the form of a flat panel. The table top 45 is welded to upper ends of the legs 46 such that the table top 45 is disposed in a raised position with respect to the seat portions 341 of the chair members 34. The table top 45 thus permits the placing of food, drinks, and other objects thereon.

Figure 2:
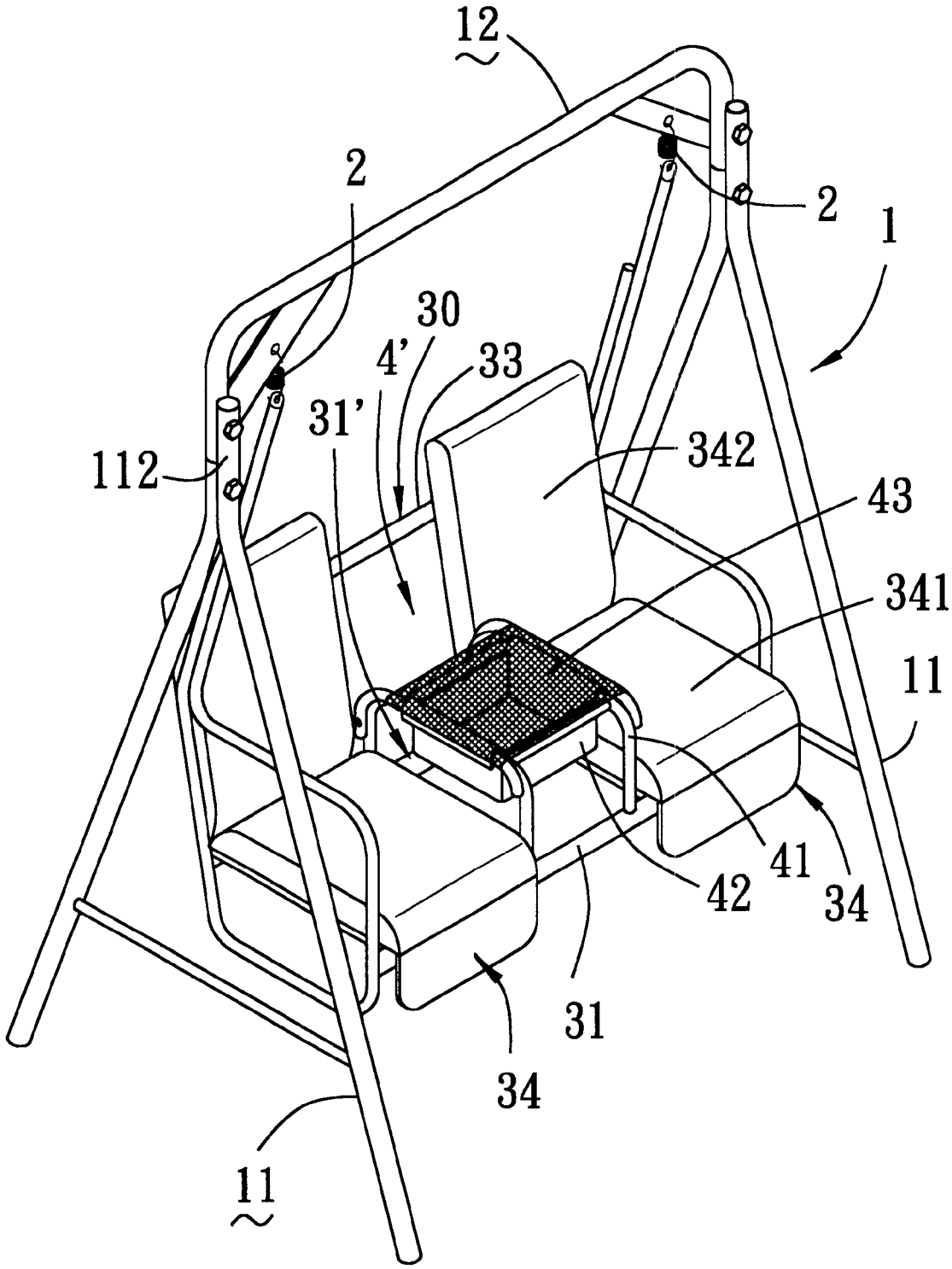
FIG. 2 is a perspective view of a second preferred embodiment of the swing chair assembly of the present invention.

Referring to FIG. 2, the second preferred embodiment of the swing chair assembly of the present invention has a structure generally similar to that of the first preferred embodiment, and differs from the previous embodiment only in the construction of the table unit 4'.

Figure 3:
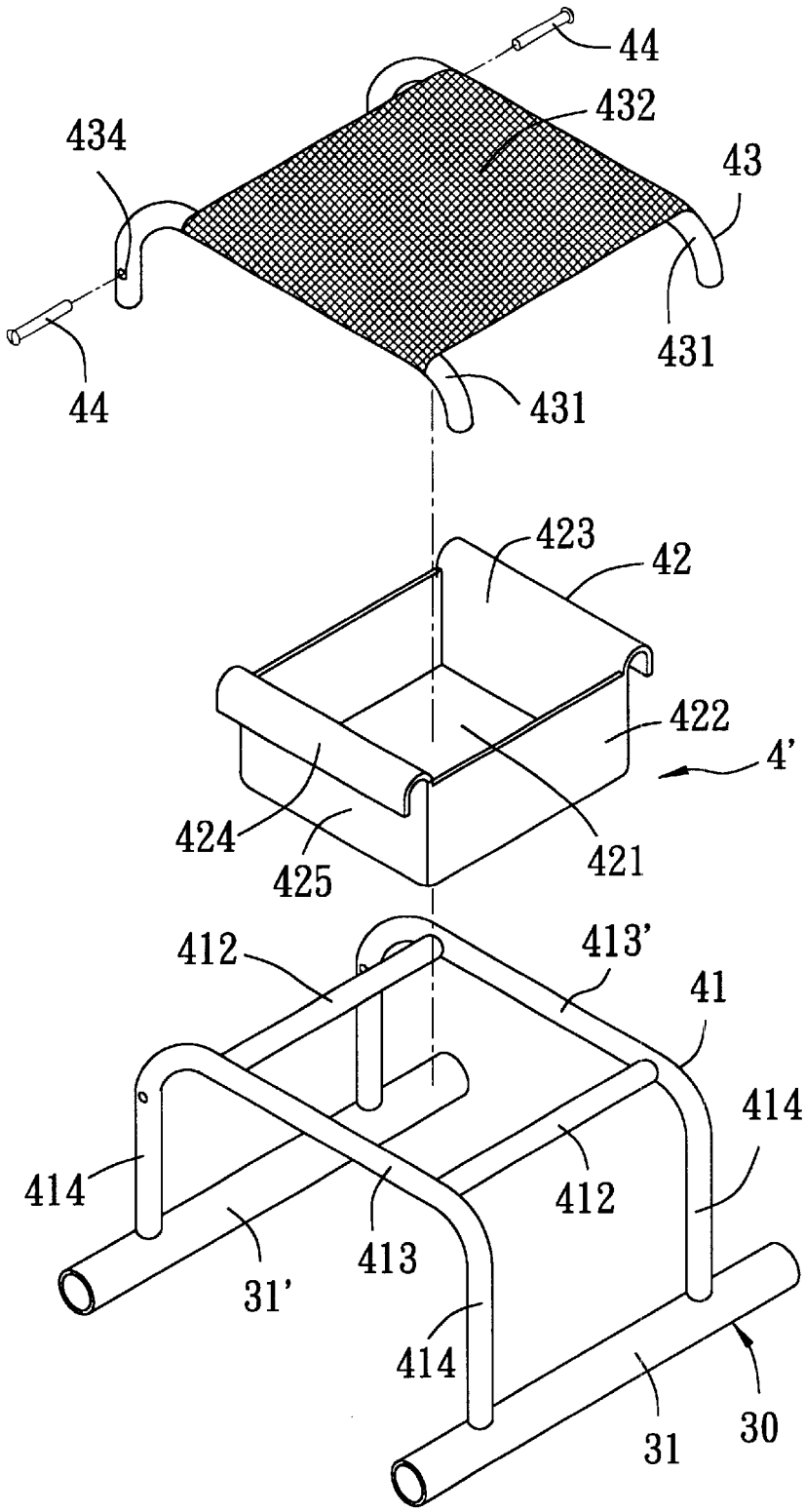
FIG. 3 is an exploded perspective view showing a table unit of the swing chair assembly of the second preferred embodiment.
Figure 5:
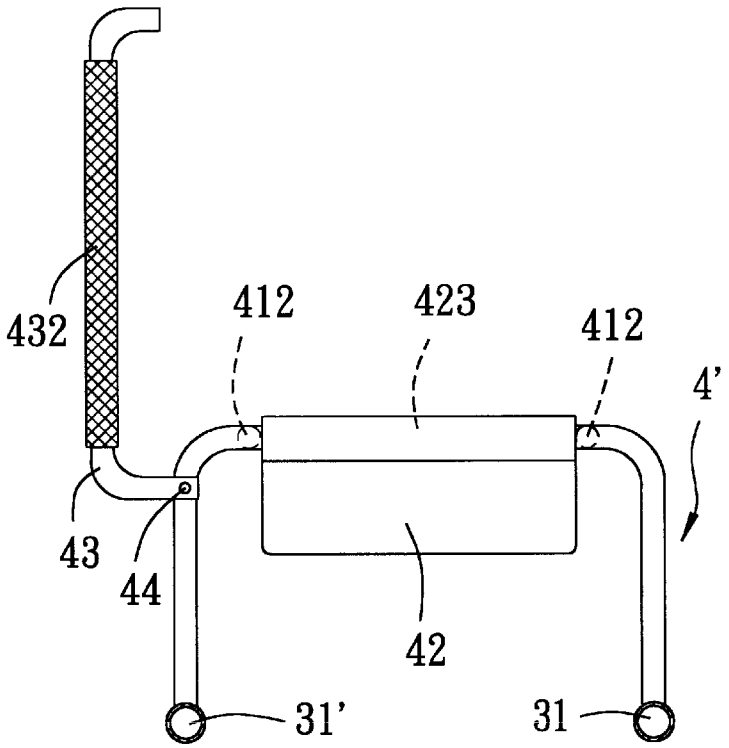
FIG. 5 is another schematic side view illustrating the table unit of FIG. 3 in an open position.
Figure 4:
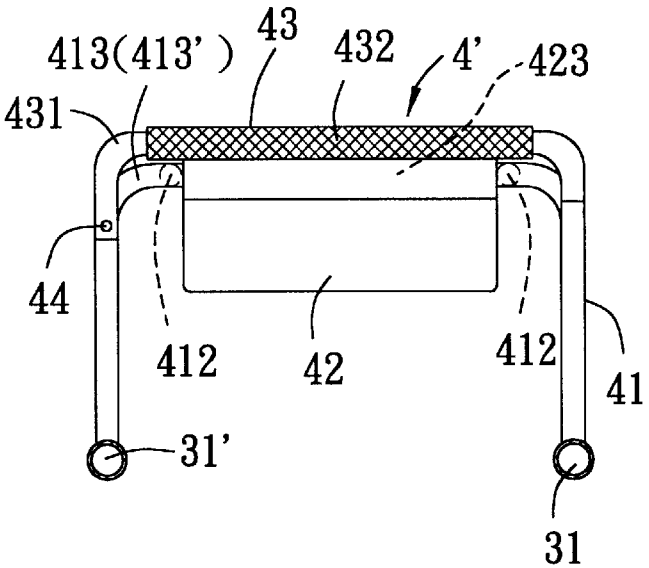
FIG. 4 is a schematic side view illustrating the table unit of FIG. 3 in a closed position.

With further reference to FIG. 3, the table unit 4' includes a leg unit 41 welded to the front and rear bottom rails 31, 31' of the seat frame 30. The leg unit 41 includes four upright leg members 414, a horizontal first connecting rod 413 extending in a direction transverse to the bottom rails 31, 31' and interconnecting integrally upper ends of a first adjacent pair of the leg members 414, a horizontal second connecting rod 413' parallel to the first connecting rod 413 and interconnecting integrally upper ends of a second adjacent pair of the leg members 414, and horizontal front and rear bridging rods 412 extending transversely between the first and second connecting rods 413, 413' and welded to the first and second connecting rods 413, 413'. The bridging rods 412 are spaced apart in a longitudinal direction of the connecting rods 413, 413'. A container 42 is disposed among the first and second connecting rods 413, 413' and the bridging rods 412. The container 42 has a rectangular bottom wall 421 with left and right edges and front and rear edges, front and rear side walls 422 extending upwardly from the front and rear edges of the bottom wall 421, and left and right side walls 425 extending upwardly from the left and right edges of the bottom wall 421. The side walls 422, 425 constitute a surrounding wall of the container 42, and cooperate with the bottom wall 421 to confine a receiving space with a top opening 423. Each of the left and right side walls 425 has an upper end formed with a hook member 424 that extends outwardly and that curves downwardly for hooking at a respective one of the first and second connecting rods 413, 413' so as to retain the container 42 on the leg unit 41. A table top 43 is disposed above the container 42, and includes left and right side rods 431, each of which has a downwardly curving rear end formed with a pivot hole 434, and a panel 432 extending between the side rods 431. The panel 432 is formed as a flat screen slat. The rear ends of the side rods 431 are pivoted to upper ends of a posterior pair of the legs 414 of the leg unit 41 by a pair of horizontal pivot pins 44 such that the table top 43 is pivotable with respect to the leg unit 41 about a horizontal pivot axis parallel to the horizontal bar 12 and such that the table top 43 is turnable forwardly for moving to a closed position, as shown in FIG. 4, and is turnable rearwardly for moving to an open position, as shown in FIG. 5. In the closed position shown in FIG. 4, the panel 432 of the table top 43 rests on the first and second connecting rods 413, 413', and covers the top opening 423 of the container 42. At this time, the table top 43 is oriented horizontally and is disposed in a raised position with respect to the seat portions 341 of the chair members 34 to permit placing of food, drinks and other objects thereon. The distance between the side rods 431 is slightly greater than that between the first and second connecting rods 413, 413' such that the side rods 431 flank the first and second connecting rods 413, 413', respectively, when the table top 43 is in the closed position. In the open position shown in FIG. 5, the table top 43 is moved away from the top opening 423 of the container 42 to permit access into the receiving space of the container 42 via the top opening 423.

It has been shown that the swing chair assembly of the present invention is provided with a table unit 4, 4' to permit the placing of food, drinks, and other objects thereon. In the second preferred embodiment, a container 42 is provided below the table top 43 for receiving objects therein and is easily accessible by turning the table top 43 upwardly and rearwardly.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A swing chair assembly comprising:

a support unit including a pair of spaced-apart upright side frames with lower end portions adapted to be supported on a ground surface, and upper end portions, and a horizontal bar extending between and interconnecting said upper end portions of said side frames;

a seat unit disposed among said side frames and said horizontal bar; and a pair of linking units spaced-apart along a longitudinal direction of said horizontal bar, each of said linking units having an upper end connected pivotally to said horizontal bar, and a lower end connected pivotally to said seat unit, thereby suspending said seat unit swingably above the ground surface;

said seat unit including a seat frame pivoted to said lower ends of said linking units, at least one chair member mounted on said seat frame, said chair member including a horizontal seat portion with a rear end, and an upright backrest portion extending upwardly from said rear end of said seat portion, and a table unit mounted on said seat frame and disposed adjacent to said seat portion of said chair member, said table unit having a horizontal table top which is disposed in a raised position with respect to said seat portion of said chair member, wherein said seat frame includes front and rear bottom rails parallel to said horizontal bar of said support unit, said seat portion of said chair member resting on said bottom rails, said table unit including a leg unit that has a lower end connected to said bottom rails, and an upper end opposite to said lower end, said table top being disposed on said upper end of said leg unit; and wherein said leg unit includes four upright leg members, each of which has a lower end connected to one of said bottom rails, and an upper end opposite to said lower end, said leg unit further including a horizontal first connecting rod extending in a direction transverse to said bottom rails and interconnecting upper ends of a first adjacent pair of said leg members, a horizontal second connecting rod parallel to said first connecting rod and interconnecting upper ends of a second adjacent pair of said leg members, and horizontal front and rear bridging rods parallel to each other and extending transversely between said first and second connecting rods, said front and rear bridging rods being spaced apart in a lengthwise direction of said first and second connecting rods.

2. The swing chair assembly as claimed in claim 1, wherein said table top is formed as a flat panel.

3. The swing chair assembly as claimed in claim 1, wherein said table unit further includes a container disposed below said table top, said container having a bottom wall and a surrounding wall extending upwardly from said bottom wall and cooperating with said bottom wall to confine a receiving space with a top opening, said container being disposed among said first and second connecting rods and said front and rear bridging rods, said surrounding wall having an upper end provided with a pair of hook members for hooking at a respective one of said first and second connecting rods so as to retain said container on said leg unit, said table top having one end pivoted to said leg unit so as to be pivotable about a horizontal axis for moving between a closed position, in which said table top is disposed on said first and second connecting rods to cover said top opening of said container, and an open position, in which said table top is moved away from said container to permit access into said receiving space of said container via said top opening.

4. The swing chair assembly as claimed in claim 3, wherein said bottom wail is rectangular in shape and has front, rear, left and right edges said surrounding wall including front and rear side walls extending upwardly and respectively from said front and rear edges of said bottom wall and left and right side walls extending upwardly from said left and right edges of said bottom wall, each of said left and right side walls having an upper end formed with a respective one of said hook members.

5. The swing chair assembly as claimed in claim 3, wherein said table top includes a pair of side rods, and a panel extending between said side rods, each of said side rods having a rear end pivoted to said upper end of a corresponding one of said leg members that is connected to said rear bottom rail, said table top being turnable forwardly for moving to said closed position, and being turnable rearwardly for moving to said open position.

6. The swing chair assembly as claimed in claim 1, wherein said seat unit includes two of said chair members, said table unit being disposed between said seat portions of said chair members.

7. A swing chair assembly comprising:

a support unit including a pair of spaced-apart upright side frames with lower end portions adapted to be supported on a ground surface, and upper end portions, and a horizontal bar extending between and interconnecting said upper end portions of said side frames;

a seat unit disposed among said side frames and said horizontal bar; and a pair of linking units spaced apart along a longitudinal direction of said horizontal bar, each of said linking units having an upper end connected pivotally to said horizontal bar, and a lower end connected pivotally to said seat unit, thereby suspending said seat unit swingably above the ground surface;

said seat unit including a seat frame pivoted to said lower ends of said linking units, said seat frame including a bottom rail parallel to said horizontal bar of said support unit, at least one chair member mounted on said seat frame, said chair member including a horizontal seat portion with a rear end, and an upright backrest portion extending upwardly from said rear end of said seat portion, said seat portion of said chair member resting on said bottom rail, and a table unit mounted on said seat frame and disposed adjacent to said seat portion of said chair member, said table unit including a leg unit that has a lower end connected to said bottom rail, and an upper end opposed to said lower end, said table unit further including a horizontal tabletop disposed on said upper end of said leg unit such that said table top is raised with respect to said seat portion of said chair member, said leg unit including two upright leg members, each of which has a lower end connected to said bottom rail, and an upper end opposite to said lower end, said leg unit further including horizontal first and second connecting rods, each of which extends from said upper end of a respective one of said leg members in a direction transverse to said bottom rail.

8. The swing chair assembly as claimed in claim 7, wherein said table unit further includes a horizontal bridging rod extending transversely between said first and second connecting rods.

9. The swing chair assembly as claimed in claim 7, wherein said table unit further includes a container disposed below said table top, said container having a bottom wall and a surrounding wail extending upwardly from said bottom wall and cooperating with said bottom wall to confine a receiving space with a top opening, said container being disposed between said first and second connecting rods, said surrounding wall having an upper end retained on said first and second connecting rods, said table top being movably disposed on said leg unit and being movable from a closed position, in which said table top is disposed on said first and second connecting rods to cover said top opening of said container, to an open position, in which said table top is moved away from said container to permit access into said receiving space of said container via said top opening.

10. The swing chair assembly as claimed in claim 9, wherein said table top is connected pivotally to said leg unit to permit turning movement of said table top from one of said closed and open positions to the other of said closed and open positions.

11. The swing chair assembly as claimed in claim 7, wherein said seat unit includes two of said chair members, said table unit being disposed between said seat portions of said chair members.

* * * * *